United States Patent [19]

Pelosi, Jr.

[11] 4,060,025

[45] Nov. 29, 1977

[54] AIR DISTRIBUTION CEILING

[76] Inventor: Michael H. Pelosi, Jr., 520 Abbott Drive, Broomall, Pa. 19008

[21] Appl. No.: 728,258

[22] Filed: Sept. 30, 1976

[51] Int. Cl.[2] ..... F24F 7/00

[52] U.S. Cl. ..... 98/40 DL; 29/428; 52/28; 52/484; 52/732; 55/508; 362/294; 362/373

[58] Field of Search ..... 98/40 D, 40 DL; 240/47, 240/9 A; 55/508; 52/484, 613, 72, 28, 732; 248/173, 140, 143; 29/428

[56] References Cited

U.S. PATENT DOCUMENTS

| | | | |
|---|---|---|---|
| 2,303,745 | 12/1942 | Karreman | 52/613 |
| 3,219,810 | 11/1965 | Hickman | 240/47 |
| 3,396,997 | 8/1968 | Adams | 52/484 |
| 3,475,869 | 4/1969 | Jahn | 52/732 |
| 3,701,895 | 10/1972 | Sweetser | 98/40 DL |
| 3,975,995 | 8/1976 | Shuler | 98/40 D |
| 3,998,419 | 12/1976 | Semmerling | 248/323 |

*Primary Examiner*—William E. Wayner
*Assistant Examiner*—Robert J. Charvat
*Attorney, Agent, or Firm*—Zachary T. Wobensmith, 2nd; Zachary T. Wobensmith, III

[57] ABSTRACT

An air distribution ceiling for clean rooms is disclosed which includes a first or primary plenum chamber at the top of a room with a clean air supply communicating with it, the top of this chamber being bounded by the room ceiling and the bottom being bounded by a plurality of vertically spaced horizontal interlocked upper panels, a second plenum chamber bounded at the top by the upper panels and at the bottom by lower horizontal interlocked panels and forming the ceiling of the room. The panels are carried on spaced parallel supporting bars suspended from the top wall of the room and extending therealong, the supporting bars being held in spaced relation by spacer bars extending therebetween and having ledges to carry the upper and lower plates and to permit the insertion and removal of the lower panels from below. The panels each has a plurality of nozzle holes therethrough for downward air delivery and to provide for uniform air displacement within the room. The panels are formed of synthetic plastic material, the upper panels preferably being of transparent material and the lower panels being of translucent material, and can have strip fluorescent lights installed thereabove at the top of first chamber to illuminate the room.

9 Claims, 4 Drawing Figures

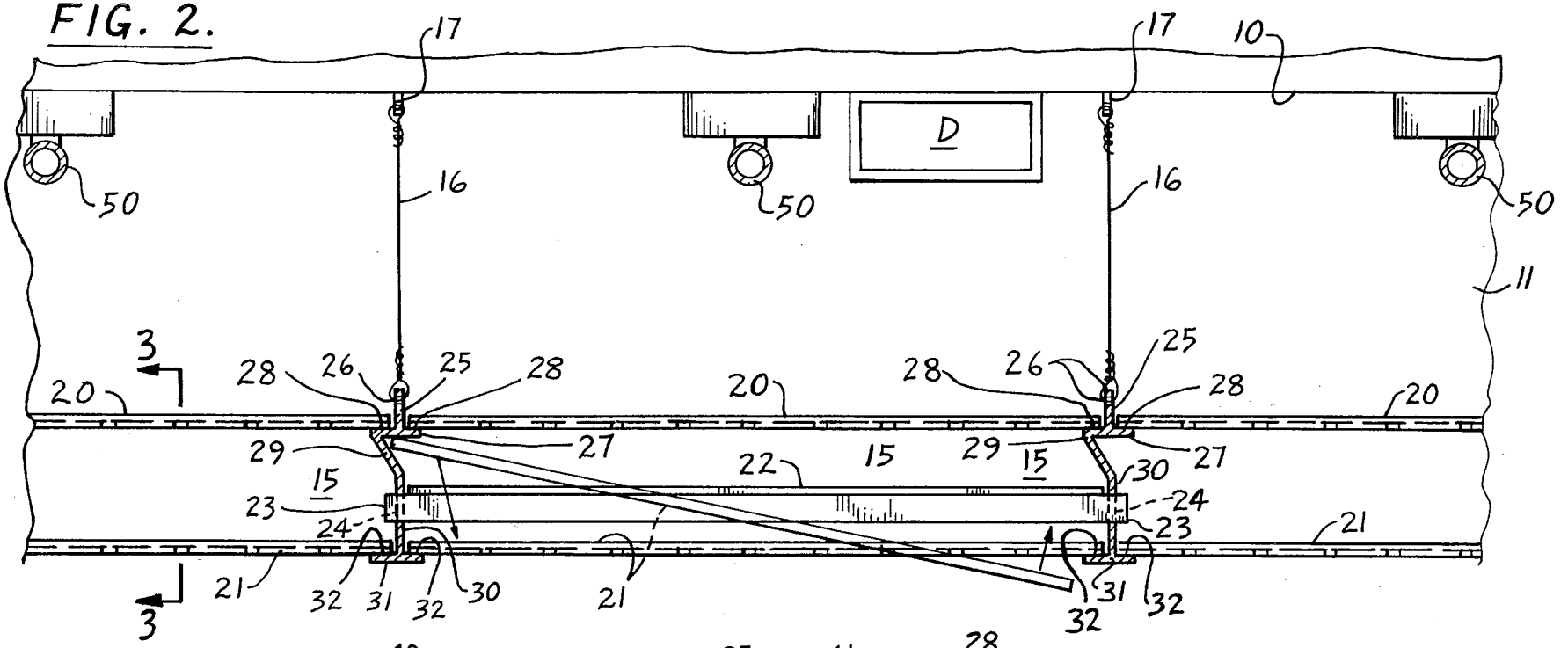
FIG. 2.
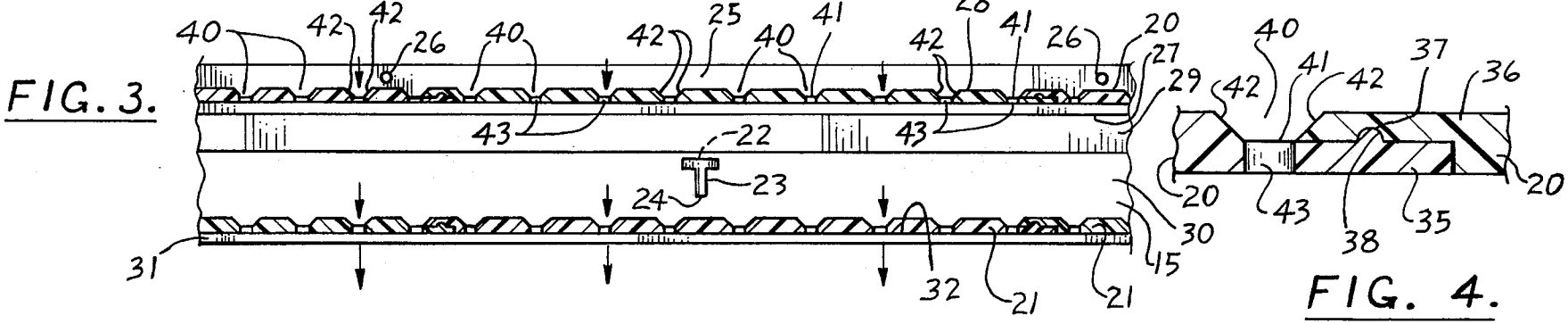
FIG. 3.
FIG. 4.

AIR DISTRIBUTION CEILING

BACKGROUND OF THE INVENTION

1. Field of the Invention

This invention relates to air distribution systems for clean rooms having a double plenum chamber part of which forms the ceiling of the room and which also permits of room illumination through the plenum chambers.

2. Description of the Prior Art

It has heretofore been proposed, as in the U.S. Pats. to Larsson, No. 3,216,183, Roux, No. 3,320,404, Carnes, No. 3,403,614, Kodaras, No. 3,429,250 and Horneff et al., No. 3,824,909 to mount panels in spaced relation to the main ceiling of a room and through which air moves downwardly for ventilating purposes.

Liberman, in U.S. Pat. No. 3,835,606 and Watters, in U.S. Pat. No. 2,935,151 drops ceilings employing one level of panels.

It has also been proposed with drop ceilings of panels all at the same level, to mount light sources on the main ceiling as in the U.S. Pats. to Guth, No. 2,803,741 and Watters et al., No. 2,935,151, with delivery of light through panels.

It has also heretofore been proposed as in the U.S. Pat. to Horneff et al., No. 3,824,909 to employ a perforated pipe delivering air to a perforated clean room ceiling for distribution through the clean room ceiling.

Larkfeldt, in U.S. Pat. No. 3,631,788 shows the use of a pressure box for air distribution through a hung ceiling into a room but the construction is complicated, expensive to construct and does not provide uniform air distribution nor light passage.

Lindestrom, in U.S. Pat. No. 3,726,204 shows an air distribution device with an upper chamber from which air passes through spaced perforated plates to a zone in a room. The structure is difficult and expensive to manufacture, does not permit of light transmission nor easy access thereabove.

The structures of the prior art lack the simplicity of construction, ease of installation and ready access thereabove, must be tailor made and have other shortcomings.

SUMMARY OF THE INVENTION

This invention relates to an air distribution ceiling for clean rooms in which vertically spaced upper and lower panels supported from the main ceiling, the upper panels bounding a first plenum chamber at the top of the room, a clean air supply connection into the first chamber, a second plenum chamber below the first chamber, the panels being mounted in spaced supports suspended from the room top wall, the supports being held in parallel relation, the panels at one level preferably being transparent and the panels at another level preferably being translucent for light transmission from strip lights mounted on the room top wall. The supports permit easy installation and access thereabove, the lower panels preferably being insertable and removable from below.

The principal object of the invention is to provide an air distribution ceiling for clean rooms which provides for completely uniform air displacement through the ceiling.

A further object of the invention is to provide an air distribution ceiling for clean rooms with room illumination by lights mounted thereabove.

A further object of the invention is to provide an air distribution ceiling for clean rooms which can be easily installed and maintained.

A further object of the invention is to provide an air distribution ceiling for clean rooms which can be utilized in rooms of varying sizes without varying the structural components of the air distribution ceiling.

A further object of the invention is to provide an air distribution ceiling in which the components are relatively simple and inexpensive, and which may be readily assembled.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 2 is a fragmentary vertical sectional enlarged view, taken approximately on the line 2—2 of FIG. 1;

FIG. 3 is a fragmentary vertical sectional view taken approximately on the line 3—3 of FIG. 2; and FIG. 4 is a fragmentary vertical sectional view showing a preferred form of end joint for the panels.

Figure 1:
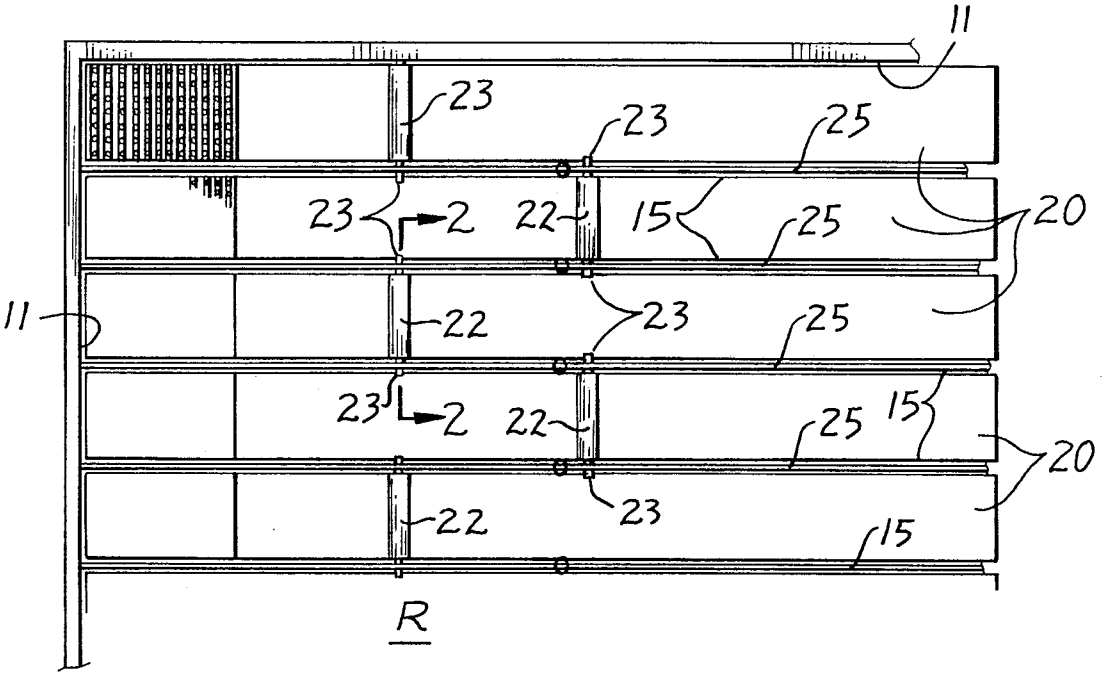
FIG. 1 is a fragmentary horizontal or plan view showing an air distribution ceiling in accordance with the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, the air distribution ceiling of my invention is shown in place in a portion of a clean room R which has a supply of clean air brought thereinto at the top and which removes the used air at the bottom in a well known manner for return to the supply for filtration and reuse.

The room R has a horizontal top wall or main ceiling 10 and vertical side walls 11.

The clean air is brought into the room R through duct D from the clean air supply (not shown) preferably through a side wall 11.

A suspended air distribution ceiling to be described preferably covers the entire room.

Support bars 15 are provided suspended from the top wall or main ceiling 11 preferably by wires 16 engaged in screw eyes 17 mounted in the ceiling 11. The support bars 15 extend from one end wall 11 to the opposite end wall 11 of the room R. The support bars 15 can be in sections disposed end to end but if sections are employed the ends are staggered with respect to the ends of contiguous bars 15.

The support bars 15 are disposed in parallel, preferably on approximately sixteen inch centers.

The support bars 15 support upper ceiling panels 20 and lower ceiling panels 21 between two adjacent bars 15 across the entire room width with additional parallel panels 20 and 21 supported on parallel bars 15. The support bars 15 are preferably held in spaced parallel relation to T-bars 22 which have end tongues 23, rectangular in cross section, engaged in complemental slots 24 in the support bars 15.

The support bars 15 and the T-bars 22 are preferably of light weight material, such as aluminum or aluminum alloys, and are preferably formed as extrusions.

Each of the support bars 15 has a vertically upwardly extending rib 25 with openings 26 for engagement by the wires 16. The rib 25 extends upwardly from a horizontal portion 27 with upper faces 28 for supporting the upper panels 20.

The horizontal portion 27, at one side edge thereof preferably has connected thereto a downwardly inclined web portion 29 from which a central vertical web portion 30 extends downwardly to a horizontal portion 31 with upper faces 32 for supporting the panels 21.

The offsetting of the web portion 29, as explained below, permits of inserting and removing the lower panels 21 from below.

The upper panels 20, shown in FIG. 1 and in detail in FIGS. 2 and 3, are rectangular in shape, of a width for easy reception between the ribs 28 and of a length for easy handling.

The upper panels 20 are each provided with end edge portions 35 and 36, the edge portion 35 being the leading edge portion and having a thickness extending upwardly from the bottom face of approximately one half the panel thickness with a slight rib 37 extending across the panel between the edges 23. The trailing edge portion 36 has a thickness extending downwardly from the upper face 22 of approximately one half the panel thickness with a groove 38 for engagement by the rib 37 when the edge portions 35 and 36 are in overlapped relation in assembled condition.

The upper panels 20 are of any suitable material and preferably of transparent or translucent synthetic plastic material for light transmission downwardly therethrough.

The upper panels 20 are preferably provided with a plurality of parallel transverse grooves 40 having flat horizontal bottom faces 41 and inclined or beveled side faces 42. The bottom faces 41 have a plurality of spaced holes 43 extending therethrough, the holes in a particular embodiment having a diameter in the range of 0.060 to 0.125 inches and a typical panel being provided with holes 32 having a total free area from about 2.0% to 5.0%. The inclined or beveled faces 42 guide the air into the holes 43 for delivery below.

The lower panels 21 are similar to the panels 20 in size and shape, have similar end edge portions 35 and 36, with ribs 37 and grooves 38 and with parallel grooves 40, beveled side faces 42, bottom faces 41 and spaced holes 43.

The lower panels 21 can be made of the same material as the upper panels 20 but if the upper panels 20 are transparent it is preferred that the lower panels 21 be translucent.

Strip fluorescent lights 50 of well known type can be provided, mounted to the top wall or ceiling 10 of room R and with the panels 20 and 21 of plastic material approximately 70% of the available light will be permitted to pass therethrough and provide suitable room illumination.

In order to assemble the ceiling, the support bars 15 are hung from the ceiling 10 by the wires 16 and the T-bars 22 are inserted to retain the support bars 15 in spaced parallel relation. Upper panels 20 are then mounted on and supported by the faces 25 and are slid along these faces to fill the longitudinal space from wall to wall. The panels 20 are mounted with their end edge portions 35 and 36 in engagement as shown in FIG. 4. Any excess in length can be readily trimmed.

The lower panels 21 are then inserted from below, the longitudinal edge at the left (see FIG. 2) being inserted first, the opposite longitudinal edge being then seated on the faces 32 and the first mentioned longitudinal edge being lowered to seat on the contiguous face 32.

Should access be desired to replace the tubes or ballast of the fluorescent lights 50, it is a simple matter to remove one or more of the panels 20 and 21 and to replace them when repairs are completed.

The space between the upper panels 20 and the ceiling 10 provides a primary plenum chamber for delivery of air thereto through the duct D and then through the openings 43 in the panel 20.

The space between the panels 20 and 21 provides a secondary plenum chamber for delivery of air through the openings 43 in the panel 21.

With the structure as shown and described completely uniform air delivery in a manner referred to as laminar flow, and with non-aspirating characteristics is provided.

If desired for a lower class environment and where the height above the support bars is limited, only one level of panels 21 could be employed.

I claim:

1. A support member for the panels of an air distribution system comprising a unitary elongated bar having an upper attaching rib, an upper horizontally extending portion below said rib with horizontal panel supporting faces therealong, a lower horizontally extending portion below said upper portion with horizontal panel supporting faces therealong, and a vertically disposed connecting portion between said horizontally extending portions and having a portion thereof offset to provide a clearance for insertion of the panels from below.

2. An air distribution system as defined in claim 1 in which each of said panels has a plurality of grooves on the upper face thereof, and said openings in said panels extend from bottom portions of said grooves.

3. An air distribution system as defined in claim 1 in which said offset portion extends from one edge of the upper horizontally extending portion.

4. An air distribution system for a room having a ceiling and side walls extending downwardly from the ceiling comprising a plurality of elongated spaced parallel support members spaced below said ceiling, spacer members in engagement with said support members at predetermined intervals along the lengths of said support members, each of said support members comprising a unitary bar having upper panel supporting portions extending along each side thereof, and spaced therebelow, lower panel supporting portions extending along each side thereof, said support members between said upper and lower panel supporting portions having transverse longitudinally extending offset portions permitting insertion of panels from below, and a plurality of panels at at least one level supported by opposite panel supporting portions of contiguous support members, said panels having a plurality of openings therethrough for downward air delivery.

5. An air distribution system as defined in claim 4 in which each of said upper and lower panel supporting portions of contiguous support members has upper and lower panels supported thereon, and each of said panels has a plurality of openings therethrough for downward air delivery therethrough, the space above said upper panels provides a primary plenum chamber and the space between said upper and lower panels providing a secondary plenum chamber.

6. An air distribution system as defined in claim 5 in which each of said panels has an end edge portion for overlapping engagement with an end edge portion of the next panel.

7. An air distribution system as defined in claim 6 in which said edge portions have interengaging members thereon.

8. An air distribution system as defined in claim 5 in which said panels are of light transmitting material.

9. An air distribution system as defined in claim 8 in which a light source is provided disposed above said panels for illumination of the space therebelow.

* * * * *